United States Patent [19]

Fukuda et al.

[11] Patent Number: 4,846,448

[45] Date of Patent: Jul. 11, 1989

[54] APPARATUS FOR IMPROVEMENT OF IRON LOSS OF ELECTROMAGNETIC STEEL SHEET OR AMORPHOUS MATERIAL

[75] Inventors: Bunjiro Fukuda; Toshitomo Sugiyama; Keiji Sato; Atsuhito Honda, all of Chiba, Japan

[73] Assignee: Kawasaki Steel Corporation, Kobe, Japan

[21] Appl. No.: 209,845

[22] Filed: Jun. 22, 1988

Related U.S. Application Data

[62] Division of Ser. No. 921,523, Oct. 21, 1986, Pat. No. 4,772,338.

[30] Foreign Application Priority Data

Oct. 24, 1985 [JP] Japan ..... 60-236271
Dec. 26, 1985 [JP] Japan ..... 60-291841
Dec. 26, 1985 [JP] Japan ..... 60-291846
Dec. 26, 1985 [JP] Japan ..... 60-291847
Dec. 26, 1985 [JP] Japan ..... 60-291850

[51] Int. Cl.[4] ..... C21D 9/54
[52] U.S. Cl. ..... 266/103; 148/112
[58] Field of Search ..... 266/103; 148/112

[56] References Cited

U.S. PATENT DOCUMENTS 4,062,528 12/1977 Olivero ..... 266/103

*Primary Examiner*—Peter D. Rosenberg
*Attorney, Agent, or Firm*—Balogh, Osann, Kramer, Dvorak, Genova & Traub

[57] ABSTRACT

A process and an apparatus for improving iron loss of electromagnetic steel sheet or amorphous material are disclosed. In this case, the steel sheet or amorphous material is subjected to an irradiation of plasma flame under specified conditions.

1 Claim, 6 Drawing Sheets

APPARATUS FOR IMPROVEMENT OF IRON LOSS OF ELECTROMAGNETIC STEEL SHEET OR AMORPHOUS MATERIAL

This is a divisional of co-pending application Ser. No. 921,523 filed on Oct. 21, 1986, now U.S. Pat. No. 4,772,338.

BACKGROUND OF THE INVENTION

1. Field of the Invention

This invention relates to a process and an apparatus for considerably reducing an iron loss of a magnetic material such as grain oriented electromagnetic steel sheets, amorphous material or the like used in transformers and so on.

2. Related Art Statement

The iron loss of the grain oriented electromagnetic steel sheet is a heat energy loss generated from the steel sheet in use as a core of a transformer or the like. Lately, a demand for reducing the heat energy loss, i.e. the iron loss of the grain oriented electromagnetic steel sheet is increasingly enhanced in view of energy-saving.

In order to reduce the iron loss, there have been made various attempts such as high alignment of crystals of steel sheet into {110}<001> orientation, rising of Si amount for increasing electrical resistance of steel sheet, decreasing of impurities, and further thinning of steel sheet gauge. However, the reduction of iron loss by these metallurgical methods substantially gets to a limit.

Therefore, there are proposed some methods for improving the iron loss in addition to the metallurgical method. Among them, a method of reducing the iron loss through the irradiation of a pulsed laser beam as disclosed in Japanese Patent Application Publication No. 57-2,252 or the like is actually industrialized at present. Such a method makes possible to largely reduce the iron loss as compared with the conventional methods, but can not avoid the increase of initial cost and running cost due to the fact that the equipment used is expensive and the service life of a lamp for exciting the laser beam is not long. Moreover, the laser beam used is not usually a visible ray, so that a safety means must be taken.

Furthermore, a method of irradiating a continuous laser beam is disclosed in Japanese Patent laid open Nos. 59-33,802 and 59-92,506. This method has the same drawback as in the case of the pulsed laser beam as well as drawbacks that the effect of iron loss reduction is small, the laser beam absorbance of the steel sheet inevitably changes to obtain no constant effect.

SUMMARY OF THE INVENTION

It is an object of the invention to provide a novel process for the improvement of iron loss which can considerably reduce the iron loss by a more advantageous means without causing the above drawbacks in view of the productivity, workability, safety and cost.

The inventors have made various studies in order to solve the above problems and found that considerable reduction of the iron loss is obtained by irradiating a plasma flame to a surface of a grain oriented electromagnetic steel sheet after final annealing, and as a result the invention has been accomplished.

According to the invention, there is the provision of a process for improving an iron loss of a grain oriented electromagnetic steel sheet, which comprises irradiating a plasma flame to the surface of said steel sheet after final annealing.

BRIEF DESCRIPTION OF THE DRAWINGS

The invention will be described with reference to the accompanying drawings, wherein.

Figure 4:
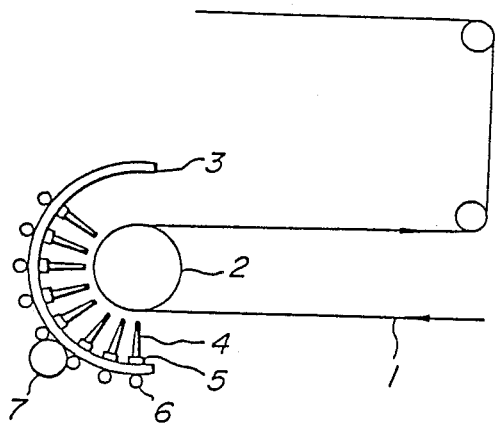
FIG. 4 is a schematic view of an embodiment of the apparatus for the improvement of iron loss.
Figure 6:
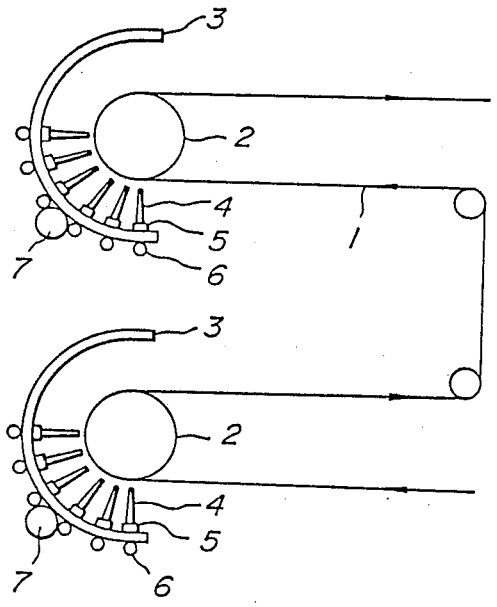
Figure 7:
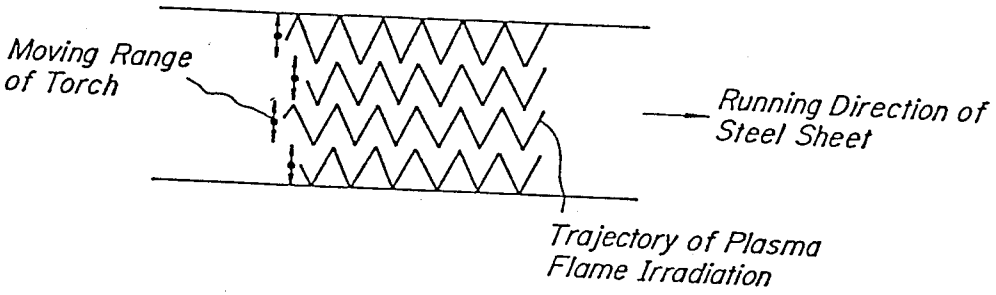
Figure 8:
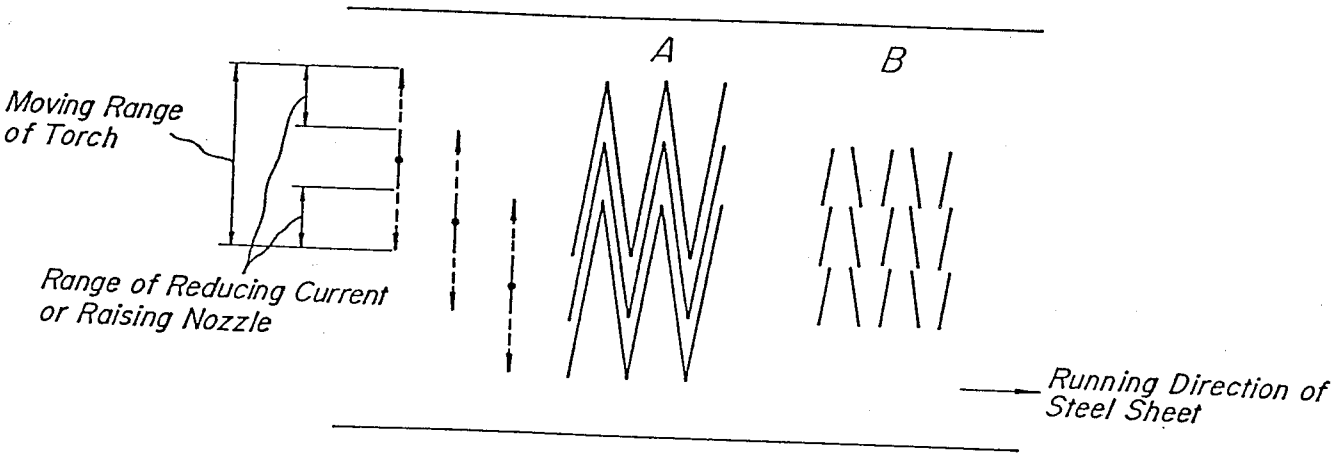

Fi9. 5 is a left-hand side view of FIG. 4;

FIG. 6 is a schematic view of arranging a plurality of apparatuses shown in FIG. 4; and FIGS. 7 and 8 are irradiation trajectories of plasma flame over a moving range of a torch, respectively.

DESCRIPTION OF THE PREFERRED EMBODIMENTS

The invention will be first described with respect to experimental details resulting in the success of the invention.

A plasma flame was irradiated to a grain oriented electromagnetic steel sheet of 0.23 mm in thickness after final annealing through a torch having a nozzle hole diameter of 0.05–2.5 mm.

The plasma was generated by applying a voltage across a cathode consisting mainly of tungsten and an anode and flowing an argon gas or a mixed gas of argon and hydrogen.

An output current can be increased as the nozzle hole diameter becomes large, and in this case it was varied within a range of 1 A–300 A.

The plasma flame was irradiated as a continuously linear form in a direction substantially perpendicular to the rolling direction of the steel sheet, wherein the irradiation interval in the rolling direction was 6.35 mm. The relative speed between the plasma flame and the steel sheet determining a retention time of the irradiated plasma flame was varied within a range of 1 mm/sec–4,000 mm/sec.

Figure 1:
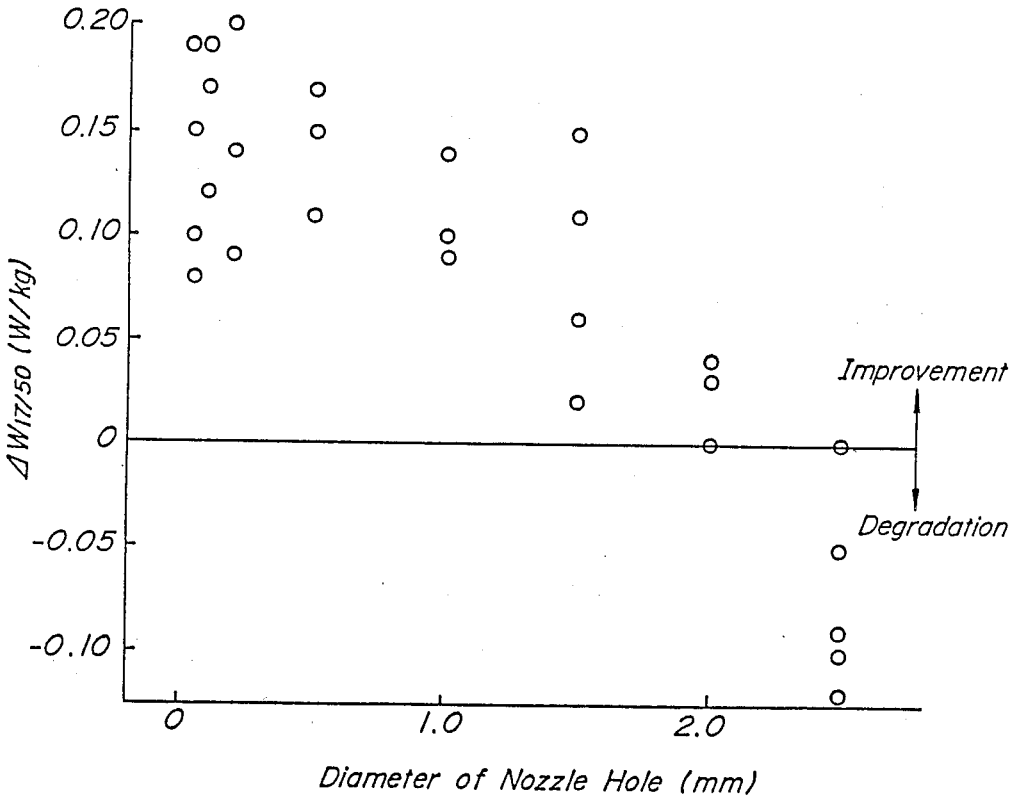
FIG. 1 is a diagram illustrating a relation between a diameter of a nozzle hole for the irradiation of plasma flame and an amount of iron loss reduced.

As a result of experiments under the above-mentioned wide conditions, it has newly been found that the iron loss is improved by properly selecting the output current and the relative speed between the plasma flame and the steel sheet at each of the nozzle hole diameter except that the nozzle hole diameter is larger than 2.0 mm. These experimental results are shown in FIG. 1, which indicates a difference of iron loss $\Delta W_{17/50}$ (magnetic flux density 1.7T, 50 Hz) before and after the irradiation of plasma flame. From FIG. 1, it is obvious that the iron loss is largely improved at the nozzle hole diameter of not more than 2.0 mm.

Then, the inventors have examined the effect of average grain size (average diameter assuming that the secondary recrystallized grain is close to circle) and magnetic flux density $B_{10}$ at a magnetization force of 1,000 A/m in the steel sheet on the loss reduction by plasma flame irradiation. The final annealed steel sheet used had an average grain size of 1–10 mm and $B_{10}$ of 1.80–1.96T. The plasma flame using an argon gas was irradiated through a nozzle hole of 0.25 mm in diameter at an output current of 5 A. In the irradiation of the plasma flame, the plasma torch was moved at a speed of 400 mm/sec in a direction perpendicular to the rolling direction of the steel sheet. The irradiation interval in the rolling direction was varied within a range of 2–25 mm. The gauge of the steel sheet was 0.30 mm, 0.27 mm, 0.23 mm, 0.20 mm or 0.15 mm. The magnetic properties of the steel sheet before and after the irradiation of plasma flame were measured with a single sheet tester.

Figure 2:
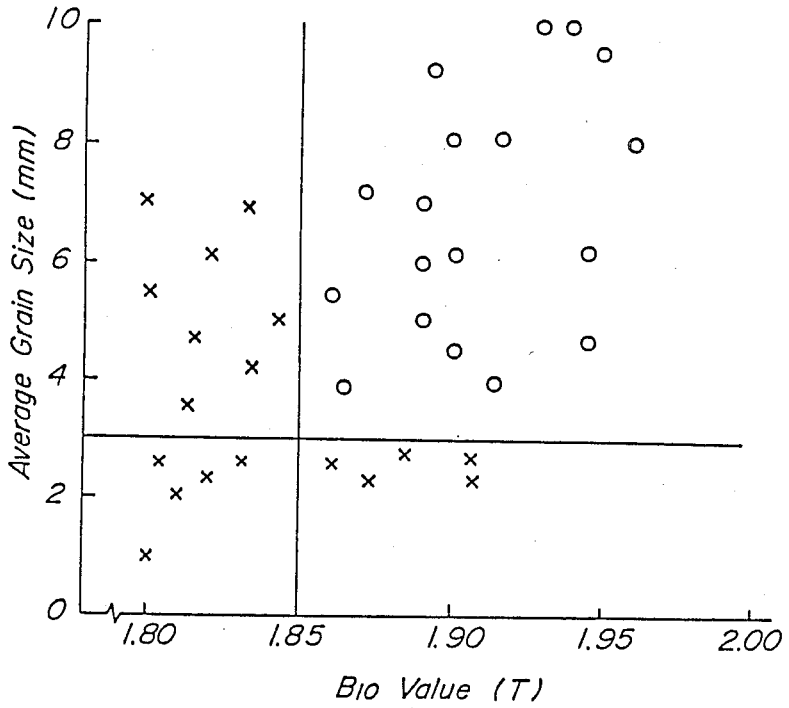
FIG. 2 is a diagram showing effects of the average grain size and $B_{10}$ value of the steel sheet on the loss reduction by plasma irradiation.

In FIG. 2 is shown the difference of iron loss ($W_{17/50}$) before and after the irradiation of plasma flame to $B_{10}$ and average grain size, wherein mark "o" is a case that the iron loss is improved by at least 0.03 W/kg through the irradiation of plasma flame. The degree of the improvement in the iron loss through the irradiation of plasma flame was 0.25 W/kg at maximum. Further, mark "x" is a case that the iron loss is unchanged or degraded.

As seen from FIG. 2, it has newly been found that the large reduction of the iron loss is observed by irradiating the plasma flame to the steel sheet having the average grain size of not less than 3 mm and the $B_{10}$ value of not less than 1.85T.

Next, there was examined an influence of plasma current density I (A/mm$^2$) (plasma current/area of nozzle hole) and relative speed S (mm/sec) between plasma irradiating nozzle and steel sheet on the improvement of iron loss. The relative speed between plasma irradiating nozzle and steel sheet determines the retention time of the irradiated plasma flame and is a moving speed of the irradiating nozzle when the steel sheet is stationary. The inventors have first examined the aforementioned influence at such a state that stress is not applied to the steel sheet, and then examined the influence at states that the bending stress and tensile stress are applied to the steel sheet, respectively.

The steel sheet used was a finally annealed grain oriented electromagnetic steel sheet of 0.23 mm in thickness. The plasma flame was irradiated through a nozzle hole of 0.1–2.0 mm in diameter while using Ar gas. The output current of the plasma flame was varied within a range of 1 A-300 A, while the relative speed S between the nozzle and the steel sheet was varied within a range of 1 mm/sec–4,000 mm/sec. The experiment was carried out by changing a ratio S/I of the relative speed to plasma current density I (A/mm$^2$) in accordance with the variation of the above values. The ratio S/I was in a range of 0.001–100.

Since the length of the plasma flame is dependent on the nozzle hole diameter and the current, the distance between the steel sheet and the nozzle was varied within a range of 0.1 mm–50 mm. The plasma flame was irradiated at an irradiation interval of 7.5 mm in a direction perpendicular to the rolling. direction of the steel sheet while applying to the steel sheet a bending stress $\sigma_R$ (kg/mm$^2$) by matching the rolling direction of the steel sheet with a circumferential direction of a roll having a radius of 60–6,000 mm and a tensile stress $\sigma_T$ (kg/mm$^2$) of 0–30 kg/mm$^2$ in the rolling direction.

In this case, when the radius of the roll is small, the tension is made low, while when the tension is high, the roll diameter is made large, whereby the roll diameter and tension are selected within a range of causing no plastic deformation of the steel sheet. And also, the experiment was carried out by applying only the tensile stress on the plane. The bending stress $\sigma_R$ is given by $\sigma_R = Et/2R$, wherein E is a Young's modulus (kg/mm$^2$) of the steel sheet, t is a gauge (mm) of the steel sheet, and R is a radius (mm) of the roll.

The iron loss $W_{17/50}$ of the steel sheet before and after the irradiation of plasma flame was measured with a single sheet tester to examine the effect of the plasma flame irradiation.

Figure 3:
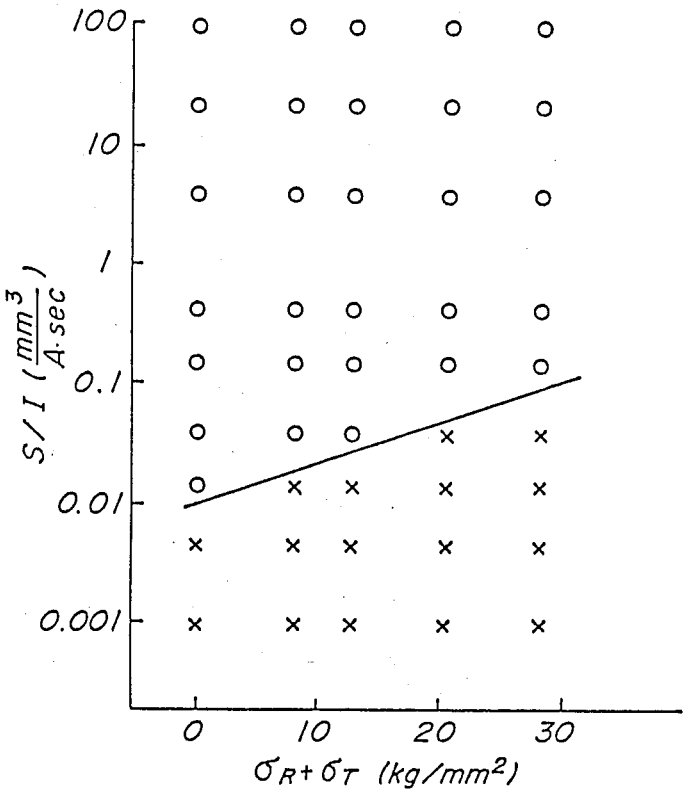
FIG. 3 is a diagram showing the effect of iron loss reduction through plasma flame irradiation as a relation between S/I and $\sigma_R+\sigma_T$.

The results are shown in FIG. 3, wherein mark "o" is a case that the iron loss is improved above 0.02 W/kg, and mark "x" is a case that the iron loss is unchanged or degraded.

As seen from FIG. 3, the effect of reducing the iron loss by the plasma flame irradiation is dependent upon S/I and the sum of tensile and bending stresses $\sigma_R + \sigma_T$, and particularly the effect by the plasma flame irradiation is improved when S/I and $\sigma_R + \sigma_T$ satisfy the following relationship:

$$\log S/I \geqq -2 + 0.033(\sigma_T + \sigma_R)$$

The grain oriented electromagnetic steel sheet used for the plasma flame irradiation according to the invention is a secondary recrystallized steel sheet after the final annealing, which is, for example, produced in. such a manner that a hot rolled steel sheet containing MnS, MnSe, AlN, Sb and the like as an inhibitor is subjected to a single cold rolling or a two stage cold rolling through an intermediate annealing to provide a final gauge and further to a decarburization annealing and then the thus treated steel sheet is coated with a slurry of an annealing separator consisting mainly of MgO and subjected to a final annealing at a high temperature of about 1,200° C.

In general, the finally annealed steel sheet is covered with a forsterite coating produced in the final annealing. The plasma flame irradiation may be carried out on the forsterite, or at the state having no forsterite, or at a mirror finished state without forsterite, or on a coating which is composed mainly of phosphate and is applied onto the forsterite. Furthermore, the phosphate coating and the like may again be formed after the plasma flame irradiation.

The steel sheet after the final annealing is necessary to have an average crystal grain size of not less than 3 mm and a $B_{10}$ value of not less than 1.85T.

The plasma gas is desirable to be inert and non-oxidizing gases such as Ar, $N_2$, $H_2$ and the like and a mixed gas thereof, and also oxidizing gases or a mixed gas thereof may be used. The length of the plasma flame is dependent on the gas pressure, and it is desirable within a range of 1–50 kg/cm$^2$ in view of the cost and nozzle life. The diameter of the nozzle hole is preferably not more than 2 mm.

The irradiation of the plasma flame may be either nontransfer-type or transfer-type, but the irradiation is easy in the nontransfer-type. It is desirable that the plasma flame is linearly irradiated in a direction substantially perpendicular to the rolling direction, but the irradiation direction may be varied in a range of 45°–90° from the rolling direction. Furthermore, the irradiation may be dotted-form or curved-form in addition to the linear form. When the irradiation is linear, the distance between the lines is desirably about 2–30 mm.

The distance between the irradiating nozzle and the steel sheet cannot be specified because the length of the plasma flame changes in accordance with the nozzle hole diameter, gas pressure, plasma current, plasma torch structure and the like, but it is usually within a range of 0.1–50 mm. In order to maintain this distance constant, the control apparatus may be used.

The plasma flame is usually irradiated on one side of the sheet surface but it is acceptable to irradiate the plasma flame on both sides of the sheet surface.

The relative speed S between the irradiating nozzle and the steel sheet and the plasma current density I are within the following range:

$$\log S/I \geqq -2+0.033(\sigma_T+\sigma_R)$$

wherein $\sigma_T$ and $\sigma_R$ are stresses when irradiating plasma flame while applying tensile stress and bending stress to the steel sheet, respectively. In this case, it is necessary that $\sigma_T$, $\sigma_R$ and the sum thereof are within a range causing no plastic deformation.

Then, the inventors have found that the iron loss is reduced by irradiating the plasma flame to amorphous metal. The amorphous metal used was Metglas 2605s-2 (trade name) made by Allied Corp. The plasma flame was linearly irradiated in a direction perpendicular to the longitudinal direction of the amorphous ribbon. The irradiation interval was 5 mm. After the irradiation, the ribbon was annealed in a magnetic field and then the iron loss $W_{13/50}$ (magnetic flux density 1.3T, 50 Hz) was measured. As a result, the iron loss was $W_{13/50}=0.098$ W/kg in case of the ribbon irradiated by the plasma flame and $W_{13/50}=0.110$ W/kg in case of the ribbon not irradiated by the plasma flame and annealed in the magnetic field, from which it is recognized that the iron loss is reduced by the irradiation of the plasma flame.

The invention will be described with respect to an apparatus to be used below.

In FIG. 4 is shown an outline of the apparatus according to the invention, wherein numeral 1 is a grain oriented electromagnetic steel sheet after final annealing, which is run about a rotating drum 2 at a constant speed.

To a circular arc-like rail 3 concentrically arranged about the rotating drum 2 are attached plural torches 4 for the irradiation of plasma flame while being supported by a movable bearing 5, whereby the torch 4 for the plasma flame irradiation is synchronizedly run on the rail 3 with the steel sheet 1. That is, the moving speed of the torch 4 is set to such a state that the relative speed between the steel sheet 1 and the torch 4 becomes zero in the rolling direction of the steel sheet. At such a state, when the movable bearing 5 is moved in the widthwise direction of the steel sheet 1, the torch 4 moves across the rolling direction of the steel sheet 1, whereby the plasma flame can be irradiated to the surface of the steel sheet 1.

Moreover, the interval between the torches 4 to be arranged is set so that the irradiation interval of the plasma flame to the steel sheet 1 is 2–30 mm, and in this case, the diameter of the nozzle hole in the torch 4 is not more than 2.0 mm and the output current is within a range of 1-300 A.

Furthermore, the speed of the torch 4 synchronizedly moving with the steel sheet 1 the rail 3 is preferably 0.1–200 m/min, and the moving speed of the torch 4 across the rolling direction of the steel sheet 1 is suitably 1–4,000 mm/sec.

Figure 5:
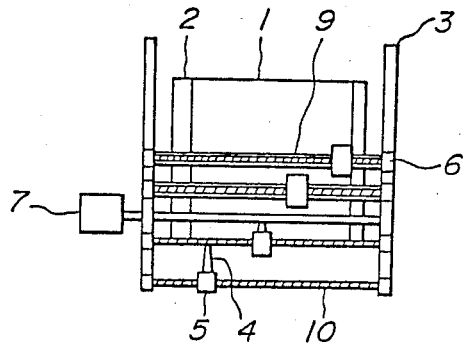

The movement of the torch 4 for the plasma flame irradiation will be described with respect to FIG. 5 showing a left-hand side view of FIG. 4.

That is, a ball screw 10 is rotated by means of a driving motor (not shown) to move the movable bearing 5, whereby the torch 4 for the plasma flame irradiation is moved in a direction perpendicular to the rolling direction of the steel sheet 1. Moreover, a support shaft 9 is arranged so as not to conduct the rotation of the movable bearing 5 together with the ball screw 10.

Further, the movement of the torch 4 on the rail 3 may be carried out, for example, by transmitting a driving force of a motor 7 to a wheel 6 and running the wheel 6 on the rail 3.

When the first torch 4 in a group of torches arrives at the end of the rail 3, the polarity of the motor 7 is switched over to rapidly return the torch group 4 to the original position. During this returning, the irradiation of the plasma flame is not performed to the steel sheet 1, so that there may be produced a portion of the steel sheet 1 not irradiated by the plasma flame. Further, it is restricted to make the torch itself compact, so that it is frequently difficult to maintain the irradiation interval of the plasma flame at the preferred range (2–30 mm). Therefore, the apparatus of FIG. 4 may be disposed in plurality for practising the plasma flame irradiation as shown in FIG. 6.

An example of irradiating the plasma flame with the above apparatus will be described below.

The plasma flame was irradiated to the finally annealed grain oriented electromagnetic steel sheet of 0.23 mm in gauge using the apparatus of FIG. 4 comprising plural torches with a nozzle hole diameter of 0.20 mm at an output current of 10 A.

An argon gas was used as a plasma gas. The plasma flame was linearly irradiated in a direction substantially perpendicular to the rolling direction of the steel sheet at an interval of 15 mm to the rolling direction Furthermore, the speed of the torch synchronizedly moving with the steel sheet was 5 m/min, and the moving speed toward the direction perpendicular to the rolling direction of the steel sheet was 350 mm/sec.

After the plasma flame irradiation, the magnetic properties were measured with respect to the irradiated portion of the steel sheet and the nonirradiated portion closest to the irradiated portion. As a result, the iron loss $W_{17/5}$ of the irradiated portion was 0.80 W/kg, while the iron loss $W_{17/50}$ of the nonirradiated portion was 0.93 W/kg. Thus, the great improvement of the iron loss was obtained by irradiating the plasma flame with the apparatus according to the invention.

Although the plasma flame was irradiated on the roll in the above apparatus, it is a matter of course that the plasma flame may be irradiated by means of an apparatus provided with torches synchronizedly running with the steel sheet on plane and moving in a direction perpendicular to the rolling direction of the steel sheet.

As shown in FIG. 7, it is considered that plural torches reciprocatedly moving in a direction substantially perpendicular to the rolling direction of the constantly running steel sheet are arranged in the widthwise direction of the steel sheet for irradiating the plasma flame. In this case, the trajectory of plasma flame irradiation is triangular wave or close to sinusoidal wave as shown in this figure. Even in this irradiation method, the effect of plasma flame irradiation is recognized, but there is a possibility that the iron loss is less improved or is degraded due to the fact that the retention time of the irradiated plasma flame becomes longer in the vicinity of the peak of the triangular wave and the irradiated portions are too close to each other. In this connection, the inventors have newly found that one or more torches are reciprocatedly moved in the widthwise direction of the sheet under such a condition that the trajectory of plasma flame irradiation formed on the sheet surface extends over a whole width of the sheet but does not include a turning region of reciprocative movement. When using a single torch, it is necessary that this torch reciprocatedly moves over the width of the sheet. On the other hand, when using plural torches, they are set so as to overlap the reciprocatedly moving ranges of these torches to each other as shown in FIG. 8. In the letter case, at least one procedure of the rising of the torch from the steel sheet surface and the reduction of the plasma current is taken in the overlapped portion, whereby the effect of plasma flame irradiation can largely be developed. When the plasma current is lower than a certain level, the irradiation effect is lost. However, such a level cannot be specified because it is dependent on the nozzle hole diameter, the retention time of plasma flame and the like, but the irradiation effect below this lower limit is substantially equal to the effect performing no irradiation. Furthermore, when the torch is raised upward from the steel sheet surface, the distance between the torch and the steel sheet becomes large and the top of the plasma flame does not arrive at the steel sheet surface and consequently the effect of plasma flame irradiation is lost. The rising distance is determined by the nozzle hole diameter, plasma current, nozzle moving speed and the like. Thus, when the plasma current is reduced or the torch is raised at the overlapped portion, the effective plasma flame irradiation substantially depicts a trajectory as shown by B in FIG. 8, so that the peak portion of the actual plasma flame trajectory shown by A in this figure disappears to more largely develop the effect of iron loss reduction.

In this connection, the invention will be described in detail below.

The grain oriented electromagnetic steel sheet of 600 mm in width and 0.23 mm in gauge after final annealing was run at a speed of 3.0 m/min, while the plasma flame was irradiated to the steel sheet from 6 plasma torches arranged in the widthwise direction of the steel sheet. In this case, the 6 torches were set so as not to overlap the reciprocatedly moving ranges with each other and reciprocatedly moved at an amplitude (peak to peak) of 100 mm. The moving speed of the torch (nozzle) was 400 mm/sec, and the nozzle hole diameter was 0.3 mm, and the plasma current was 9 A, and the distance between the nozzle and the steel sheet was 1 mm. In this way, a treated steel sheet A was obtained.

The plasma flame was irradiated under the same conditions as described above except that 10 torches were arranged so as to overlap the reciprocatedly moving ranges of these torches with each other. In this case, a treated steel sheet B was obtained by reducing the current at the overlapped portion from 9 A to 1 A, and a treated steel sheet C was obtained by raising the torch upward at the overlapped portion to change the distance between the nozzle and the steel sheet from 1 mm to 10 mm, and a treated steel sheet D was obtained by simultaneously performing the reduction of the current and the rising of the torch as described above.

The iron loss ($W_{17/50}$) before and after the plasma flame irradiation was measured with respect to these treated steel sheets A–D to obtain results as shown in the following Table 1. From Table 1, it is understood that the effect of plasma flame irradiation or the improving effect of the iron loss is large in the steel sheets B–D as compared with the steel sheet A.

TABLE 1

| Steel sheet | Before plasma flame irradiation | | After plasma flame irradiation | |
|---|---|---|---|---|
| | $B_{10}$(T) | $W_{17/50}$(W/kg) | $B_{10}$(T) | $W_{17/50}$(W/kg) |
| A | 1.93 | 0.91 | 1.92 | 0.84 |
| B | 1.93 | 0.90 | 1.93 | 0.79 |
| C | 1.93 | 0.90 | 1.93 | 0.80 |
| D | 1.93 | 0.91 | 1.93 | 0.79 |

As mentioned above, it has been found that the iron loss in the electromagnetic steel sheet and amorphous metal is improved by the irradiation of plasma flame. This is guessed due to the fact that the portion of the steel sheet irradiated by the plasma flame is magnetically made hard to conduct refinement of magnetic domains.

The following examples are given in illustration of the invention and are not intended as limitations thereof.

EXAMPLE 1

A plasma flame was irradiated to finally annealed grain oriented silicon steel sheets of 0.23 mm and A plasma flame was irradiated to finally annealed grain oriented silicon steel sheets of 0.23 mm and 0.30 mm in gauge through torches having nozzle hole diameters of 0.2 mm and 2.5 mm. An argon gas was used, and an output current was 7 A in case of the 0.2 mmΦ nozzle and 50 A in case of 2.5 mmΦ nozzle. The plasma flame was irradiated in form of continuous line in a direction perpendicular to the rolling direction, and an interval in the rolling direction was 10 mm.

The properties before and after the irradiation were measured with a single sheet tester to obtain results as shown in the following Table 2. At the nozzle hole diameter of 0.2 mm, the large improvement of the iron loss was observed even in the material having a relatively low $B_{10}$ value (magnetic flux density at a magnetic field of 1,000 A/m).

TABLE 2

| Gauge of steel sheet (mm) | Diameter of nozzle hole (mm) | Magnetic properties before irradiation | | Magnetic properties after irradiation | |
|---|---|---|---|---|---|
| | | $B_{10}$(T) | $W_{17/50}$(W/kg) | $B_{10}$(T) | $W_{17/50}$(W/kg) |
| 0.23 | 0.2 | 1.90 | 0.95 | 1.90 | 0.78 |
| " | " | 1.94 | 0.90 | 1.94 | 0.70 |
| " | 2.5 | 1.90 | 0.93 | 1.89 | 1.10 |
| " | " | 1.95 | 0.89 | 1.94 | 0.93 |
| 0.30 | 0.2 | 1.89 | 1.05 | 1.89 | 0.90 |
| " | " | 1.94 | 1.03 | 1.94 | 0.83 |
| " | 2.5 | 1.91 | 1.04 | 1.90 | 1.07 |
| " | " | 1.93 | 1.02 | 1.91 | 1.14 |

$B_{10}$: magnetic flux density at H = 1000 A/m
$W_{17/50}$: iron loss at B = 1.7 T and f = 50 Hz

EXAMPLE 2

A grain oriented silicon steel sheet after final annealing having a gauge of 0.23 mm and an average grain size and a B10 value as shown in the following Table 3 was used, to which was irradiated a plasma flame through a plasma torch having a nozzle hole diameter of 0.15 mm. The gas was an argon gas, and the current was 7 A at a voltage of 30 V.

The irradiation was carried out linealy in the direction perpendicular to the rolling direction of the steel sheet at an irradiation interval of 8.5 mm and a running speed of the torch of 200 mm/sec. The iron loss $W_{17/50}$ before and after the irradiation was measured to obtain results as shown in Table 3, from which it was confirmed that the considerable reduction of the iron loss was observed in the acceptable examples according to the invention.

TABLE 3

| Sample No. | Average grain size (mm) | $B_{10}$ value (T) | Before plasma flame irradiation $W_{17/50}$(W/kg) | After plasma flame irradiation $W_{17/50}$(W/kg) | Remarks |
|---|---|---|---|---|---|
| 1 | 2.4 | 1.88 | 0.87 | 0.88 | comparative example |
| 2 | 2.3 | 1.80 | 0.97 | 0.99 | comparative example |
| 3 | 3.5 | 1.89 | 0.90 | 0.81 | acceptable example |
| 4 | 4.0 | 1.84 | 0.96 | 0.96 | comparative example |
| 5 | 5.3 | 1.92 | 0.89 | 0.73 | acceptable example |
| 6 | 8.9 | 1.95 | 0.88 | 0.69 | acceptable example |

EXAMPLE 3

A grain oriented electromagnetic steel sheet of 0.23 mm in gauge after final annealing was set onto a surface of a roll of 200 mm in radius, to which was linearly irradiated a plasma flame in a direction perpendicular to the rolling direction. In this case, the bending stress of the steel sheet was 8 kg/mm$^2$. Similarly, the same steel sheet as described above was subjected to the plasma flame irradiation without bending in the presence or absence of a tensile stress of 8 kg/mm$^2$. The plasma gas was an argon gas, and the irradiation interval was 8 mm. The nozzle hole diameter of the plasma torch, relative speed S between the nozzle and the steel sheet and current density I were shown in the following Table 4. As seen from Table 4, when the plasma treatment satisfies the irradiation conditions as defined in the invention (Sample Nos. 2, 3,5 and 7), the excellent effect of iron loss reduction is obtained.

TABLE 4

| Sample No. | Diameter of nozzle hole (mm) | Bending stress $\sigma R$ (kg/mm$^2$) | Tensile stress $\sigma T$ (kg/mm$^2$) | Relative speed S (mm/sec) | Current density I (A/mm$^2$) | S/I (mm$^3$/A · sec) | Iron loss before irradiation $W_{17/50}$(W/kg) | Iron loss after irradiation $W_{17/50}$(W/kg) | Remarks |
|---|---|---|---|---|---|---|---|---|---|
| 1 | 0.1 | 0 | 0 | 3 | 637 | 0.00471 | 0.88 | 1.05 | comparative example |
| 2 | 0.2 | 0 | 0 | 400 | 223 | 1.79 | 0.88 | 0.78 | acceptable example |
| 3 | 0.5 | 0 | 0 | 1000 | 51 | 19.6 | 0.89 | 0.80 | acceptable example |
| 4 | 0.1 | 8 | 0 | 6 | 400 | 0.015 | 0.88 | 0.92 | comparative example |
| 5 | 0.1 | 8 | 0 | 300 | 600 | 0.5 | 0.87 | 0.72 | acceptable example |
| 6 | 0.1 | 0 | 8 | 6 | 400 | 0.015 | 0.87 | 0.90 | comparative example |
| 7 | 0.1 | 0 | 8 | 300 | 600 | 0.5 | 0.87 | 0.70 | acceptable example |

As mentioned above, the iron loss of the electromagnetic steel sheet and amorphous metal can largely be improved through the plasma flame irradiation according to the invention.

What is claimed is:

1. An apparatus for improving an ions loss of a grain oriented electromagnetic steel sheet, comprising a rotating drum guiding the running of said steel sheet after final annealing, and at least one plasma flame irradiating torch concentrically moving on said rotating drum in synchronism with said steel sheet running on said rotating drum and across the rolling direction of said steel sheet.

* * * * *